US010801444B2

(12) United States Patent
Schlecker et al.

(10) Patent No.: US 10,801,444 B2
(45) Date of Patent: Oct. 13, 2020

(54) CARBURETOR AND HANDHELD WORK APPARATUS INCLUDING A COMBUSTION ENGINE HAVING SAID CARBURETOR

(71) Applicant: Andreas Stihl AG & Co. KG, Waiblingen (DE)

(72) Inventors: Christian Schlecker, Waiblingen (DE); Malte Hartmann, Hong Kong (CN); Wolfgang Kienzle, Remseck (DE); Daisuke Suzuki, Morioka Iwate (JP); Michael Grether, Waiblingen (DE)

(73) Assignee: Andreas Stihl AG & Co. LG, Waiblingen (DE)

( * ) Notice: Subject to any disclaimer, the term of this patent is extended or adjusted under 35 U.S.C. 154(b) by 0 days.

(21) Appl. No.: 16/439,359

(22) Filed: Jun. 12, 2019

(65) Prior Publication Data

US 2019/0383235 A1 Dec. 19, 2019

(30) Foreign Application Priority Data

Jun. 19, 2018 (DE) ..... 10 2018 004 881

(51) Int. Cl.
*F02M 19/08* (2006.01)
*F02M 1/16* (2006.01)
*F02B 63/02* (2006.01)

(52) U.S. Cl.
CPC ..... *F02M 1/16* (2013.01); *F02B 63/02* (2013.01); *F02M 19/08* (2013.01)

(58) Field of Classification Search
CPC ..... F02M 1/16; F02M 19/08; F02M 19/00; F02M 19/06; F02M 17/04; F02B 63/02
USPC ..... 123/336, 357, 364, 375, 376, 378, 379
See application file for complete search history.

(56) References Cited

U.S. PATENT DOCUMENTS 3,104,617 A * 9/1963 Barr ..... F02M 1/00 417/479
3,441,010 A 4/1969 Barr et al.
3,843,755 A 10/1974 Tuckey
4,168,288 A 9/1979 Nau et al.
(Continued)

FOREIGN PATENT DOCUMENTS

DE 6801826 U 3/1969
DE 1941901 A1 2/1970
(Continued)

*Primary Examiner* — Hai H Huynh
(74) *Attorney, Agent, or Firm* — Walter Ottesen, P.A.

(57) ABSTRACT

A carburetor has a carburetor housing wherein an intake channel section is arranged. A fuel opening opens into the intake channel section. The carburetor has a fuel pump with a pump membrane delimiting a pump chamber connected to a fuel inlet. A pressure controller has a control membrane separating a control chamber from a compensation chamber. The control chamber is connected to a fuel outlet leading out from the carburetor. The compensation chamber is connected to a compensation connection. The carburetor housing has a carburetor body, a pump cover and an intermediate part arranged therebetween. The fuel inlet, the fuel outlet and the compensation connection are formed on the intermediate part. The fuel inlet, the fuel outlet and the compensation connection are arranged on the side of the carburetor that faces away from the combustion engine.

16 Claims, 8 Drawing Sheets

(56) References Cited

U.S. PATENT DOCUMENTS

| | | | | |
|---|---|---|---|---|
| 5,891,369 | A * | 4/1999 | Tuggle | F02M 1/02 261/35 |
| 6,394,424 | B2 | 5/2002 | Pattullo et al. | |
| 6,425,573 | B1 | 7/2002 | Suzuki | |
| 6,446,939 | B1 | 9/2002 | Hoppe et al. | |
| 7,527,248 | B2 * | 5/2009 | Cobb, Jr. | F02M 17/04 261/35 |
| 2015/0176531 | A1 | 6/2015 | Shebuski et al. | |

FOREIGN PATENT DOCUMENTS

| | | | |
|---|---|---|---|
| DE | 1576593 | B1 | 4/1971 |
| DE | 2255593 | A1 | 5/1974 |
| DE | 10142247 | A1 | 3/2002 |
| DE | 60005430 | T2 | 7/2004 |
| DE | 60105088 | T2 | 9/2005 |
| GB | 1410374 | A | 10/1975 |
| JP | H03-115765 | A | 5/1991 |
| JP | 08-014107 | A | 1/1996 |
| WO | 2011074404 | A1 | 6/2011 |

* cited by examiner

CARBURETOR AND HANDHELD WORK APPARATUS INCLUDING A COMBUSTION ENGINE HAVING SAID CARBURETOR

CROSS REFERENCE TO RELATED APPLICATION

This application claims priority of German patent application no. 10 2018 004 881.1, filed Jun. 19, 2018, the entire content of which is incorporated herein by reference.

FIELD OF THE INVENTION

The invention relates to a carburetor which has a carburetor housing wherein an intake channel section is arranged. A fuel opening opens into the intake channel section. The carburetor has a fuel pump with a pump membrane delimiting a pump chamber connected to a fuel inlet. A pressure controller has a control membrane separating a control chamber from a compensation chamber. The control chamber is connected to a fuel outlet leading out from the carburetor. The compensation chamber is connected to a compensation connection. The carburetor housing has a carburetor body, a pump cover and an intermediate part arranged therebetween. The invention also relates to a handheld work apparatus including a combustion engine having the carburetor.

BACKGROUND OF THE INVENTION

U.S. Pat. No. 3,843,755 A discloses a carburetor which is configured as a membrane carburetor. The carburetor has a control chamber, by way of which fuel is fed into the intake channel. The carburetor also has a fuel pump, which is integrated in the carburetor housing. The fuel inlet and the fuel outlet are formed on a common cover.

SUMMARY OF THE INVENTION

It is an object of the invention to provide a carburetor that is of a simple construction. It is also an object of the invention to provide a handheld work apparatus including a combustion engine and the carburetor that is of a simple construction.

The carburetor of the invention includes: a carburetor housing having an intake channel section arranged therein; at least one fuel opening opening into the intake channel section; a fuel pump having a pump chamber and a pump membrane delimiting the pump chamber; a fuel inlet connected to the pump chamber; a pressure controller defining a control chamber and a compensation chamber and having a control membrane mutually separating the control chamber and the compensation chamber; the control chamber supplying the at least one fuel opening; a fuel outlet leading out of the carburetor; the control chamber being connected to the fuel outlet; a compensation connection; the compensation chamber being connected to the compensation connection; the carburetor housing including: a carburetor body wherein the intake channel section is formed; a pump cover at least partially delimiting the pump chamber; and, an intermediate part disposed between the pump cover and the carburetor body; and, the fuel inlet, the fuel outlet and the compensation connection being configured on the intermediate part.

For the carburetor, it is provided that between the pump cover, which at least partially delimits the fuel pump, and the carburetor body, in which the intake channel section is formed, an intermediate part is arranged and that the fuel inlet, the fuel outlet and the compensation connection are formed on the intermediate part. The fact that the fuel inlet, the fuel outlet and the compensation connection are formed on the same component, to be specific the intermediate part, means that the individual components of the carburetor can be produced well, and advantageous channel routes are obtained in a compact construction. From the intermediate part, the fuel inlet can be diverted by a short passageway to the fuel pump, that is, in the direction of the pump cover, while the fuel outlet and the compensation connection are connected to the control chamber and the compensation chamber. As a result, a simple channel route with short passageways is obtained.

In a particularly advantageous configuration, it is provided that the fuel inlet and the compensation connection face in the same direction. In a particularly preferred configuration, the fuel inlet, the fuel outlet and the compensation connection face in the same direction. The fuel inlet, the fuel outlet and the compensation connection respectively refer here to the opening for fuel or air, which is for example formed on a corresponding connection stub, but not to the connection stub itself. The fuel inlet, the fuel outlet and/or the compensation connection may also be formed as openings on the intermediate part. In a particularly preferred configuration, the fuel inlet, the fuel outlet and the compensation connection are formed on connection stubs. Advantageously, at least the connection stubs of the fuel inlet and the compensation connection, particularly preferably all of the connection stubs, are arranged on the same side of the carburetor housing. It may however also be provided that one or more connection stubs are configured as angled away and the connection stub on one side of the carburetor housing protrudes away from the carburetor housing in a first direction and the respective opening, that is, the fuel inlet, the fuel outlet or the compensation connection, is aligned in a second direction, extending at an angle to this direction. The fact that the fuel inlet and the compensation connection, and in particular also the fuel outlet, face in the same direction means that the connections to the fuel inlet and the compensation connection, and possibly also to the fuel outlet, can be fitted in the same direction. As a result, in particular, installation space for the fitting of the connections only has to be provided on one side of the carburetor housing. A compact construction is obtained, and the fitting of the connections on the carburetor housing is simplified.

The carburetor housing advantageously has with respect to the flow direction in the intake channel section an upstream end and a downstream end. The connection stubs of the fuel inlet and the compensation connection are arranged in particular at the upstream end of the carburetor housing. Preferably, the connection stub of the fuel outlet is also arranged at the upstream end of the carburetor housing. A different position of the connection stub of the fuel outlet, in particular a position on a side running parallel to the flow direction in the intake channel, may also be advantageous.

The fuel inlet and the compensation connection are advantageously formed on connection stubs that are integrally formed on the intermediate part as one part. In a particularly preferred configuration, the fuel outlet is also formed on a connection stub that is integrally formed on the intermediate part as one part. Advantageously, the fuel inlet, the compensation connection and the fuel outlet are respectively formed on connection stubs that are integrally formed on the intermediate part as one part. As a result, a simple construction and simplified fitting are obtained. In an alternative configuration, it may however also be provided that one or more connection stubs are formed on tubular stubs, which are not formed from the same material as the main body of the intermediate part. The at least one connection stub may in particular consist of metal. In a preferred configuration, the intermediate part is an injection-molded part and the metal connection stub is overmolded by the intermediate part.

Advantageously, the compensation connection is formed on a connection stub for connecting to the clean space of an air filter. Advantageously, the connection stub of the compensation connection can be connected directly to an air filter bottom of the air filter. As a result, when the air filter bottom is being fitted, the connection of the compensation connection to the clean space of the air filter can be established at the same time, and so an additional fitting step for attaching the compensation connection is not necessary.

In an advantageous configuration, the pressure controller is delimited by the carburetor body and the intermediate part. The fuel pump is preferably delimited by the intermediate part and the pump cover. The pressure controller and the fuel pump are in particular arranged on the opposite sides of the intermediate part. As a result, the pressure controller and the fuel pump can be formed with few components. The arrangement of the pressure controller, which is arranged downstream of the fuel pump, between the carburetor body and the intermediate part produces a short passageway from the pressure controller, in particular the control chamber of the pressure controller, into the intake channel section.

At least one buffer chamber is advantageously arranged in the flow path between the fuel inlet and the fuel outlet. Preferably, at least one buffer chamber is arranged in the flow path between the fuel pump and the control chamber. Advantageously, the at least one buffer chamber is at least partially delimited by the pump membrane. An additional membrane is not required for delimiting the buffer chamber, and so a simple, compact construction is obtained. In an advantageous configuration, the pump chamber and the at least one buffer chamber are arranged on opposite sides of the pump membrane. It may however also be advantageous to arrange at least one buffer chamber and the pump chamber on the same side of the pump membrane. In an advantageous configuration, a first buffer chamber is arranged in the flow path between the fuel pump and the control chamber, and a second buffer chamber is provided downstream of the control chamber. In an alternative advantageous configuration, it is provided that a first buffer chamber is arranged upstream of the pump chamber and a second buffer chamber is arranged downstream of the pump chamber. Particularly advantageously, the surface area of the second buffer chamber is greater than the surface area of the first buffer chamber at the membrane delimiting the pump chambers. Advantageously, the first buffer chamber has a surface area, measured at the delimiting membrane, that is approximately 50% to 70% of the surface area of the pump chamber, measured at the pump membrane. The second buffer chamber advantageously has a surface area, measured at the delimiting membrane, that is approximately 20% to 30% of the surface area of the pump chamber, measured at the pump membrane. Advantageously, the pump membrane separates the at least one buffer chamber from a return chamber. In a preferred configuration, the return chamber of at least one buffer chamber is delimited by the pump cover. It may also be advantageous that the return chamber of at least one buffer chamber is delimited by the intermediate part. In a preferred configuration, the at least one buffer chamber is at least partially delimited by the intermediate part. In an advantageous configuration, the pump chamber and a first and a second buffer chamber are delimited by the intermediate part and the pump membrane.

Advantageously, the surface area of the membrane section of the pump membrane that delimits the at least one buffer chamber is comparatively large. In an advantageous configuration, it is provided that the surface area of the membrane section of the pump membrane that delimits the at least one buffer chamber is at least 25% of the surface area of the membrane section of the pump membrane that delimits the pump chamber. In a preferred configuration, the surface area of the membrane section of each buffer chamber is at least 25% of the surface area of the membrane section of the pump membrane that delimits the pump chamber.

It is provided that the pump membrane separates the pump chamber from a pulse chamber. The pulse chamber is advantageously connected by way of a pulse line to a pulse connection. The pulse line is preferably at least partially delimited by the intermediate part. By forming the pulse line at least partially in the intermediate part, a simple construction is achieved. In a particularly preferred configuration, the pulse line is formed completely in the intermediate part.

Advantageously, the pulse line runs from the intermediate part to the carburetor body and opens out at the downstream end of the carburetor body on the outer side of the carburetor. Advantageously formed on the outer side of the carburetor body is a connection to a connection flange, by way of which the carburetor is fitted on the combustion engine.

For a handheld work apparatus comprising a combustion engine for driving a tool of the work apparatus, the combustion engine having a carburetor, it is advantageously provided that the fuel inlet and the compensation connection are arranged on the side of the carburetor that is facing away from the combustion engine. As a result, fuel lines can be easily connected and the connection of the compensation connection to the air filter can be easily established. The side of the carburetor that is facing away from the combustion engine is easily accessible during fitting. Fitting only has to be performed in one direction. In a particularly preferred configuration, the fuel outlet is also arranged on the side of the carburetor that is facing away from the combustion engine.

The combustion engine advantageously takes in the combustion air by way of an air filter. The air filter preferably has, slipped onto the compensation connection, a connection stub that connects the compensation connection to a clean space of the air filter. As a result, no additional lines or the like are required for attaching the compensation connection. The connection to the clean space of the air filter is established integrally on the air filter between the air filter and the carburetor. As a result, a simple construction and easy fitting are obtained. Fitting errors are avoided when connecting the compensation connection to the clean space of the air filter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
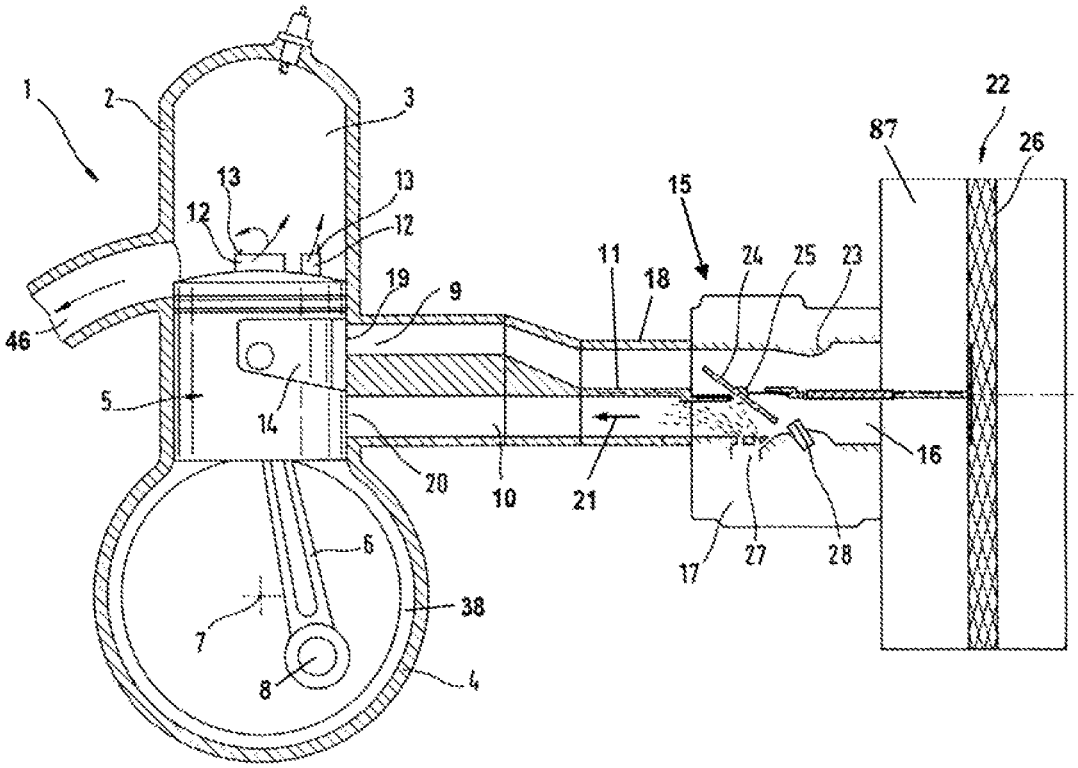
FIG. 1 shows a schematic sectional view of a combustion engine.

FIG. 1 shows a two-stroke engine as an embodiment of a combustion engine 1. However, the combustion engine 1 may also be a four-stroke engine, in particular a mixture-lubricated four-stroke engine. The combustion engine 1 has a cylinder 2, in which a combustion chamber 3 is formed. The combustion chamber 3 is delimited by a piston 5 mounted in a reciprocating manner in the cylinder 2. By way of a connecting rod 6, the piston 5 drives a crankshaft 8 rotatably mounted in a crankcase interior space 38 of a crankcase 4. The crankshaft 8 is mounted rotatably about a rotational axis 7. FIG. 1 shows the arrangement with the piston 5 close to its bottom dead center. In the region of the bottom dead center of the piston 5, the crankcase interior space 38 is fluidically connected to the combustion chamber 3 by way of transfer channels 12. The transfer channels 12 open into the combustion chamber 3 via transfer windows 13. An outlet 46 for exhaust gases leads out of the combustion chamber 3.

The combustion engine 1 takes in combustion air by way of an air filter 22 and a carburetor 15 in a flow direction 21 through an intake channel. The intake channel is divided by way of a partition wall 11 into a mixture channel 10 and an air channel 9. The mixture channel 10 opens into the crankcase interior space 38 via a mixture inlet 20 controlled by the piston 5. The air channel 9 opens via at least one air intake 19 into a region that is passed over by a piston pocket 14 at the cylinder bore. The piston pocket 14 connects the air intake 19 in the region of the top dead center of the piston 5 to the transfer windows 13. As a result, lean air, or air that is largely free from fuel, can be transferred from the air channel 9 into the transfer channels 12. The combustion engine 1 therefore operates with stratified scavenging.

The carburetor 15 is connected by way of an intermediate flange 18 to the cylinder 2 of the combustion engine 1. The carburetor 15 has a carburetor housing 17, in which an intake channel section 16 is formed. In the embodiment, the intake channel section 16 in the carburetor 15 is already divided into an air channel 9 and a mixture channel 10. In the intake channel section 16, at least one throttle element, in the embodiment a throttle flap 24, is arranged. The throttle flap 24 is pivotably mounted by a throttle shaft 25. In the region of the throttle flap 24, fuel openings 27 open into the intake channel section 16. Formed upstream of the throttle flap 24 in the intake channel section 16 is a venturi 23, in the region of which a fuel opening 28 opens into the mixture channel 10.

The air filter 22 has filter material 26, which separates a clean space 87 from the surroundings. The intake channel section 16 is connected to the clean space 87.

Figure 2:
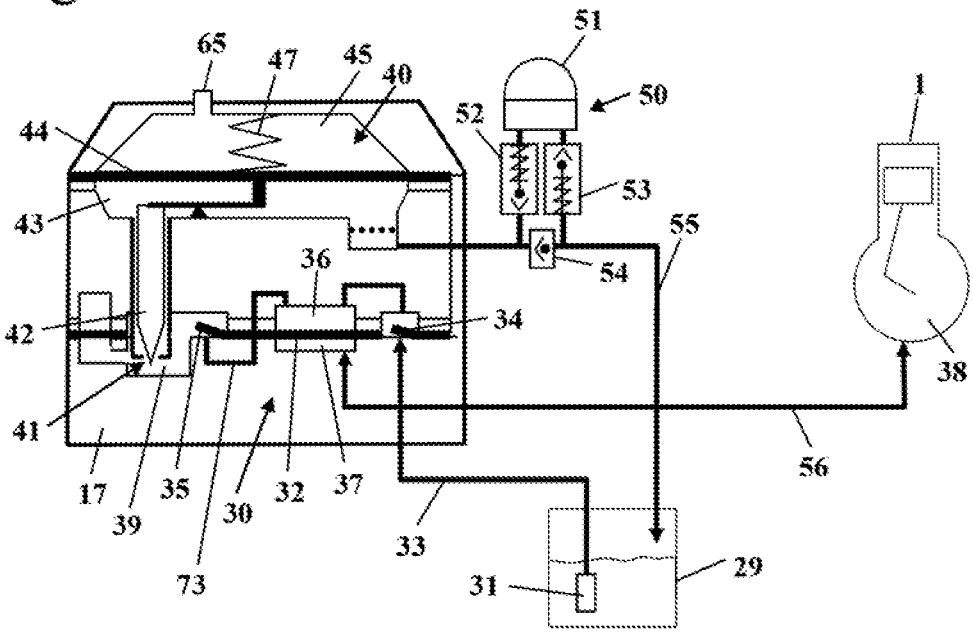
FIG. 2 shows a schematic of the fuel system of the combustion engine.

FIG. 2 schematically shows the construction of the fuel system of the combustion engine 1. The combustion engine 1 has a fuel tank 29, from which fuel is fed to the fuel openings 27 and 28 of the carburetor 15 (FIG. 1). Provided for this purpose is a suction head 31, which protrudes into the fuel tank 29. The combustion engine 1 has a fuel pump 30, which is connected to the suction head 31 by way of a fuel line 33. The fuel pump 30 comprises an inlet valve 34, a pump chamber 36 delimited by a pump membrane 32 and also an outlet valve 35. The pump membrane 32 separates the pump chamber 36 from a pulse chamber 37. The pulse chamber 37 is connected by way of a pulse line 56 to the crankcase interior space 38. On account of the varying pressure in the crankcase interior space 38 during operation, the pump membrane 32 is deflected. This has the effect that fuel is alternately taken into the pump chamber 36 by way of the inlet valve 34 and forced out of the pump chamber 36 by way of the outlet valve 35.

The outlet valve 35 sends the fuel into a fuel chamber 39. From the fuel chamber 39 there leads a control valve 41, which is part of a pressure controller 40. By way of the inlet valve 34, the fuel is fed into a control chamber 43 of the pressure controller 40, which is delimited by a control membrane 44. The control chamber 43 is in connection with the fuel openings 27 and 28 by way of fuel channels that are not shown. In the embodiment, the control membrane 44 is acted on by a spring 47. The control valve 41 has a valve body 42, the position of which is coupled to the position of the control membrane 44. If there is too little pressure in the control chamber 43, the control valve 41 opens and fuel additionally flows out of the fuel chamber 39 into the control chamber 43. The side of the control membrane 44 that is facing away from the control chamber 43 delimits a compensation chamber 45, which has a compensation connection 65. The compensation connection 65 is connected to the clean space 87 of the air filter 22 (FIG. 1).

In the embodiment, a purger 50 is arranged downstream of the control chamber 43. The purger 50 comprises a pump bellows 51, which can be actuated by the operator. The pump bellows 51 is in connection with a return line 55 by way of an inlet valve 52 and an outlet valve 53. The return line 55 opens into the fuel tank 29. Arranged in the return line 55 between the branch to the inlet valve 52 and the inlet from the outlet valve 53 is a check valve 54. The check valve 54 prevents the pump bellows 51 from being able to take in fuel through the inlet valve 52 from downstream of the check valve 54. The purger 50 may however also be omitted.

Figure 3:
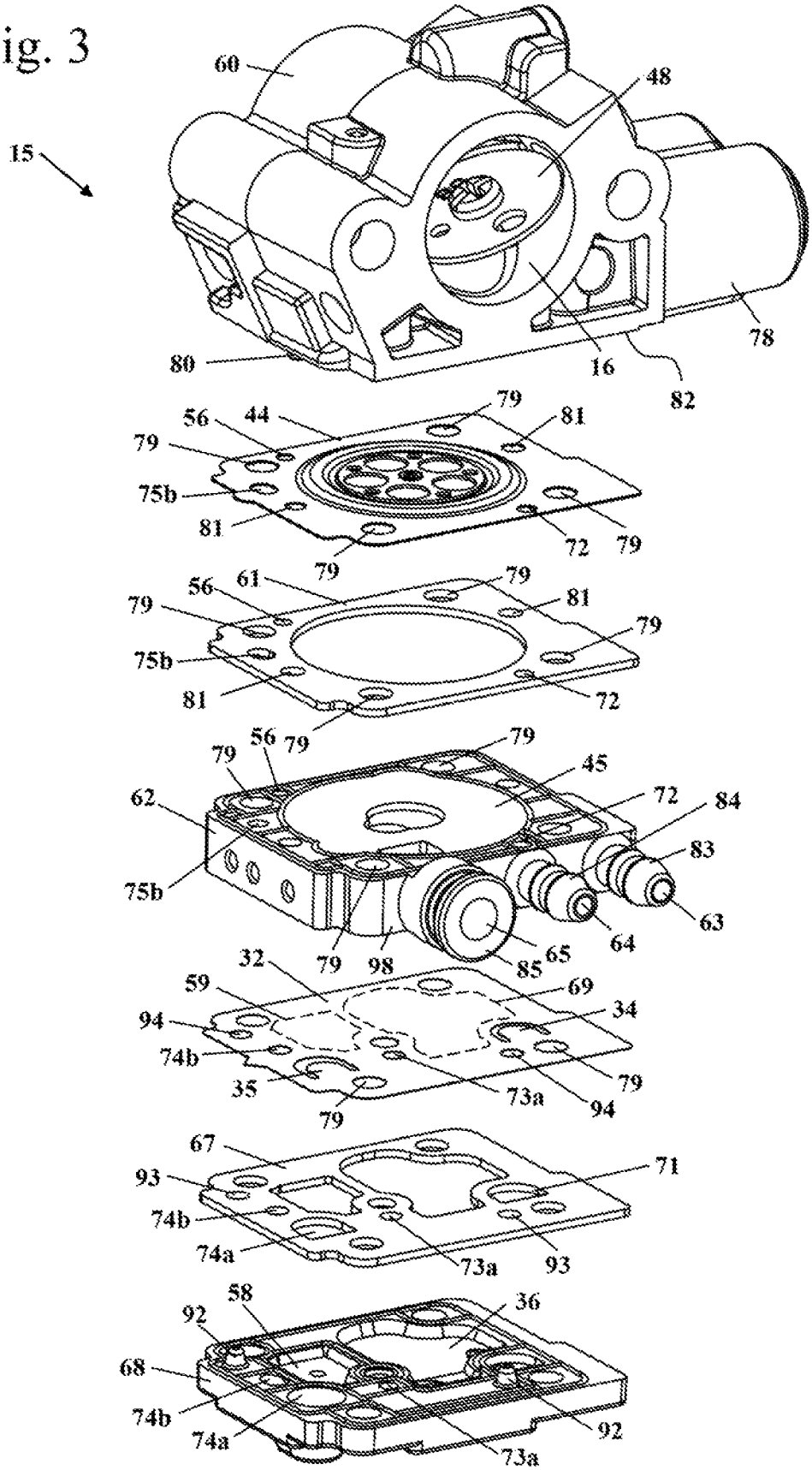
FIG. 3 shows an exploded view of the carburetor of the combustion engine.

FIG. 3 shows the construction of the carburetor 15 in detail. The carburetor 15 has a carburetor body 60, in which the intake channel section 16 is formed. A choke flap 48 that is not shown in FIG. 1 is pivotably mounted in the intake channel section 16. The choke flap 48 is arranged upstream of the throttle flap 24 (FIG. 1). Also arranged on the carburetor body 60 is a cover cap 78 for adjusting screws of the carburetor 15, in particular an idling adjusting screw and a full-load adjusting screw. The carburetor body 60 has a bottom side 82, which runs approximately parallel to the intake channel section 16. Provided on the bottom side 82 is a positioning lug 80. Arranged on the bottom side 82 of the carburetor body 60 is the control membrane 44. The control membrane 44 has positioning openings 81 for the positioning lug 80 shown in FIG. 3 and also a further positioning lug 80 on the bottom side 82 that cannot be seen.

Arranged on the side of the control membrane 44 that is facing away from the carburetor body 60 is a compensation chamber seal 61. The compensation chamber seal 61 lies between the control membrane 44 and an intermediate part 62. Formed on the intermediate part 62 are a fuel inlet 63, a fuel outlet 64 and also the compensation connection 65. The compensation chamber 45 is delimited by the intermediate part 62 and the control membrane 44 and also, at its circumference, by the compensation chamber seal 61.

Arranged on the side of the intermediate part 62 that is facing away from the compensation chamber 45 is the pump membrane 32, which has the inlet valve 34 and the outlet valve 35. Arranged on the side of the pump membrane 32 that is facing away from the intermediate part 62 is a pump sealing 67. Arranged on the side of the pump sealing 67 opposite from the pump membrane 32 is a pump cover 68. The pump cover 68 has positioning lugs 92, which protrude into positioning openings 93 of the pump sealing 67 and into positioning openings 94 of the pump membrane 32. In a preferred configuration, both the positioning lugs 80 of the carburetor body 60 and the positioning lugs 92 of the pump cover 68 protrude into the intermediate part 62, and so all of the components of the carburetor 15 are secured in position in relation to one another by way of the positioning lugs 80 and 92.

Figure 9:
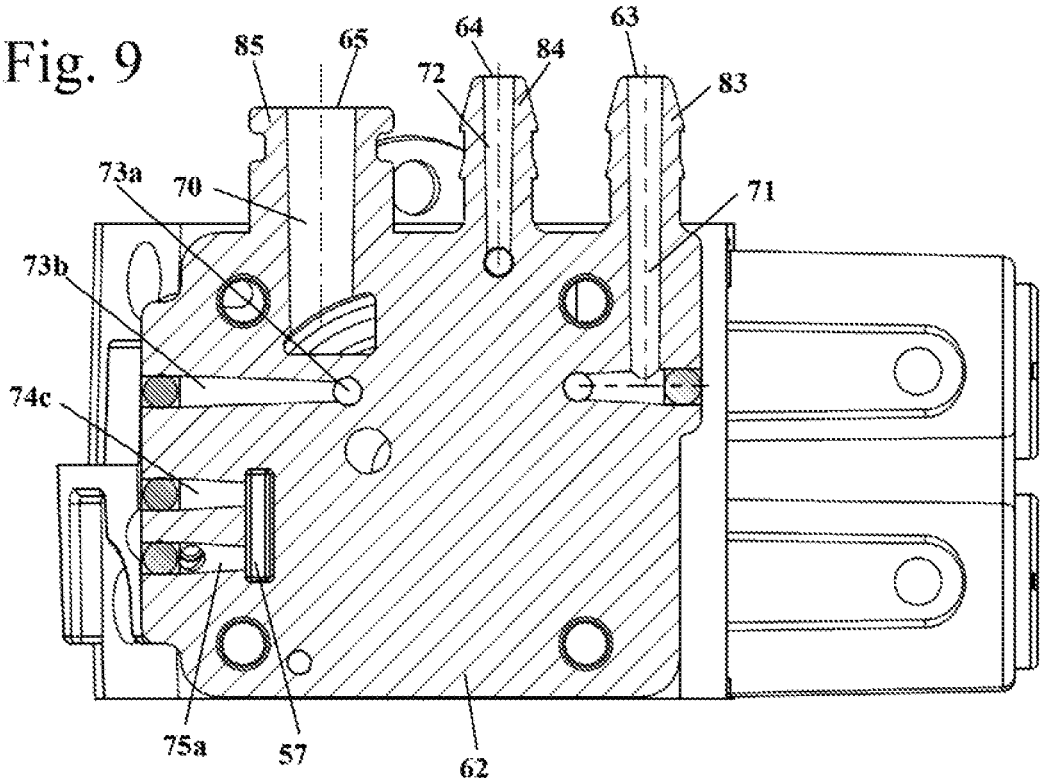
FIG. 9 shows a section along the line IX-IX in FIG. 6.

As FIG. 3 shows, the fuel inlet 63, the fuel outlet 64 and the compensation connection 65 are aligned in such a way that they face in the same direction. The fuel inlet 63, the fuel outlet 64 and the compensation connection 65 are respectively formed on connection stubs 83, 84 and 85, which are arranged on the intermediate part 62 on one and the same side 98 of the intermediate part 62. In the embodiment, the connection stubs 83, 84 and 85 are formed as one part with the intermediate part 62. This is also shown in FIG. 9. The connection stubs 83, 84 and 85 are in this case integrally formed on the intermediate part 62, that is, produced with, and from the same material as, the intermediate part 62. Preferably, the intermediate part 62 is formed together with the connection stubs 83, 84 and 85 as a plastic injection-molded part. In an alternative configuration, it may however also be provided that one or more connection stubs 83, 84 and/or 85 are formed separately from the main body of the intermediate part 62, in particular as metal pipe stubs inserted into the main body.

As FIG. 3 shows, the fuel inlet 63, the fuel outlet 64 and the compensation connection 65 are aligned in such a way that they face in the same direction. The fuel inlet 63, the fuel outlet 64 and the compensation connection 65 are respectively formed on connection stubs 83, 84 and 85, which are arranged on the intermediate part 62 on one and the same side 98 of the intermediate part 62. In the embodiment, the connection stubs 83, 84 and 85 are formed as one part with the intermediate part 62. This is also shown in FIG. 9. The connection stubs 83, 84 and 85 are in this case integrally formed on the intermediate part 62, that is, produced with, and from the same material as, the intermediate part 62. Preferably, the intermediate part 62 is formed together with the connection stubs 63, 64 and 65 as a plastic injection-molded part. In an alternative configuration, it may however also be provided that one or more connection stubs 83, 84 and/or 85 are formed separately from the main body of the intermediate part 62, in particular as metal pipe stubs inserted into the main body.

As FIG. 3 also shows, the pressure controller 40 (FIG. 2), which comprises the control membrane 44, is delimited by the carburetor body 60 and the intermediate part 62. The fuel pump 30, which comprises the pump membrane 32 and the pump chamber 36, is delimited by the intermediate part 62 and the pump cover 68. In the embodiment, the pump chamber 36 is formed in the pump cover 68.

The path of the channels in the carburetor 15 is explained below on the basis of FIGS. 3 and 7 to 13. For easier understanding, the terms "up" and "down" are used here. These refer to the position of the carburetor 15 shown in FIGS. 3 and 6 to 8 and are independent of the actual installation position.

Figure 12:
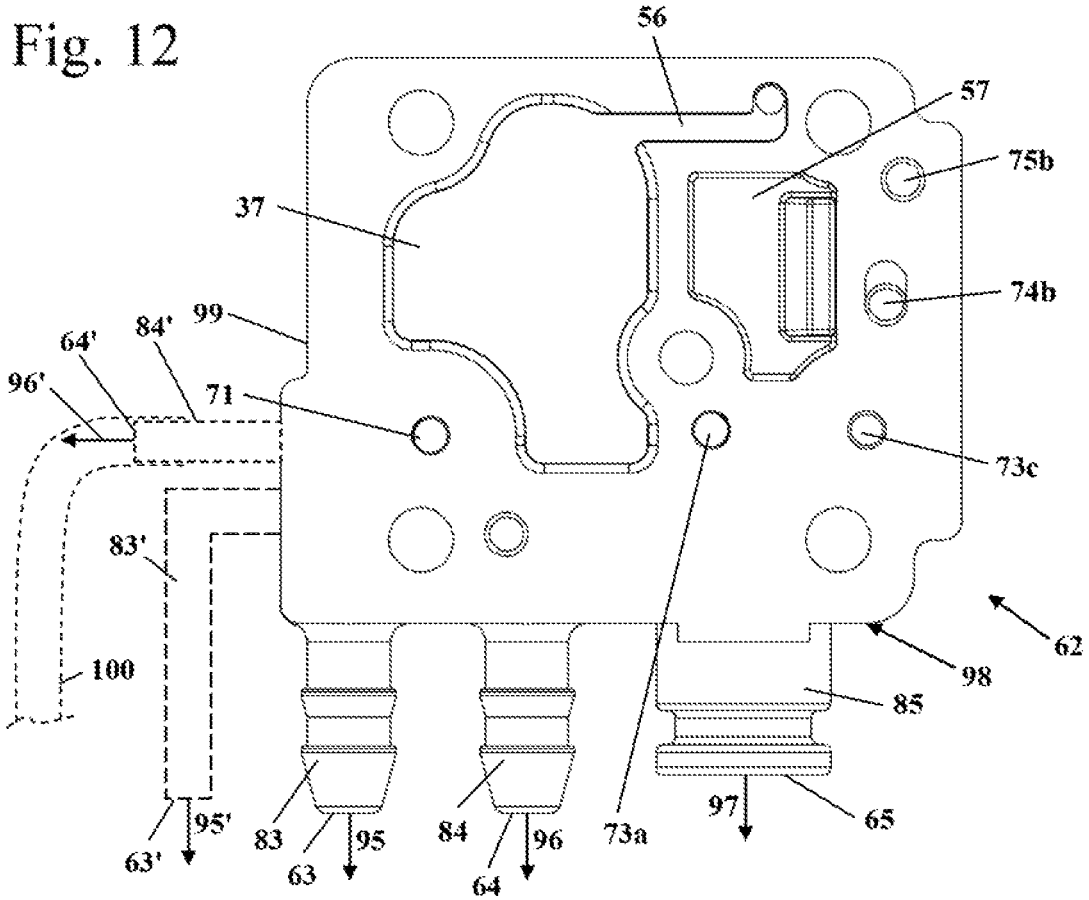
FIG. 12 shows a side view of the intermediate part in the direction of the arrow XII in FIG. 11.
Figure 13:
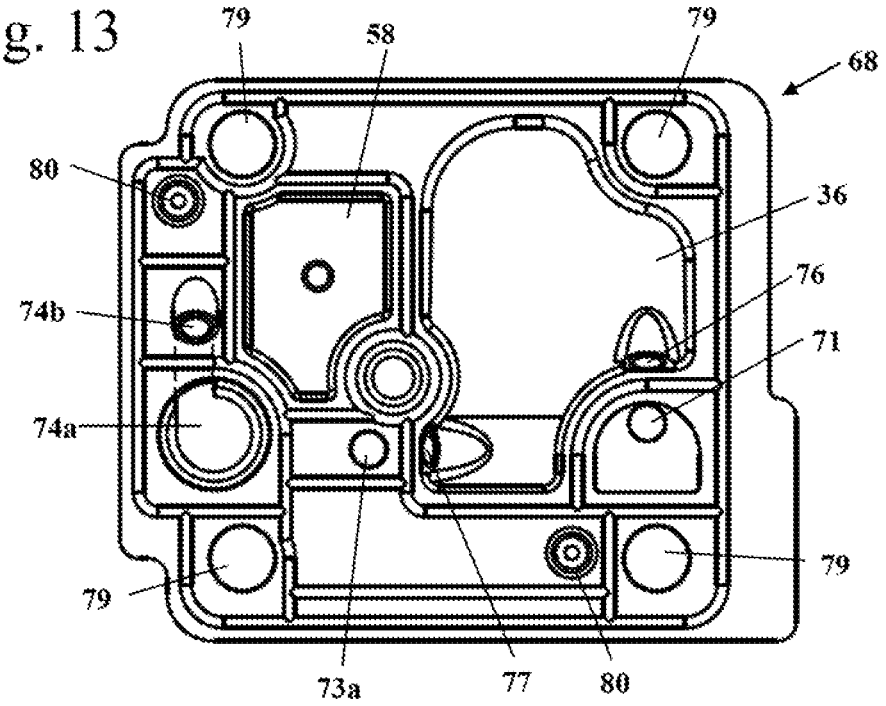
FIG. 13 shows a side view of the pump cover from the side facing the intermediate part.

As FIG. 3 shows, the fuel inlet 63 is formed on a connection stub 83 of the intermediate part 62. The fuel passes through the fuel inlet 63 into a fuel channel 71 in the intermediate part 62 (FIG. 9), which opens out on the top side of the inlet valve 34 (FIG. 3). By way of the inlet valve 34, the fuel passes downward into the pump chamber 36. As FIG. 13 shows, the fuel channel 71 is connected by way of a connection formed in the pump cover 68 to an inlet opening 76 into the pump chamber 36. As FIG. 13 also shows, the fuel leaves the pump chamber 36 by way of an outlet opening 77, which is connected to a connecting line 73*a* in the pump cover 68. The connecting line 73*a* is led through the pump sealing 67 and the pump membrane 32 upward to the intermediate part 62 (FIG. 3) and connected to a connecting line 73*b* in the intermediate part 62 (FIG. 9). The connecting line 73*b* is in contact with the connecting line 73*c* (FIG. 12), by way of which the fuel enters the fuel pump 30 (FIG. 2) from above at the outlet valve 35 (FIG. 3).

Figure 7:
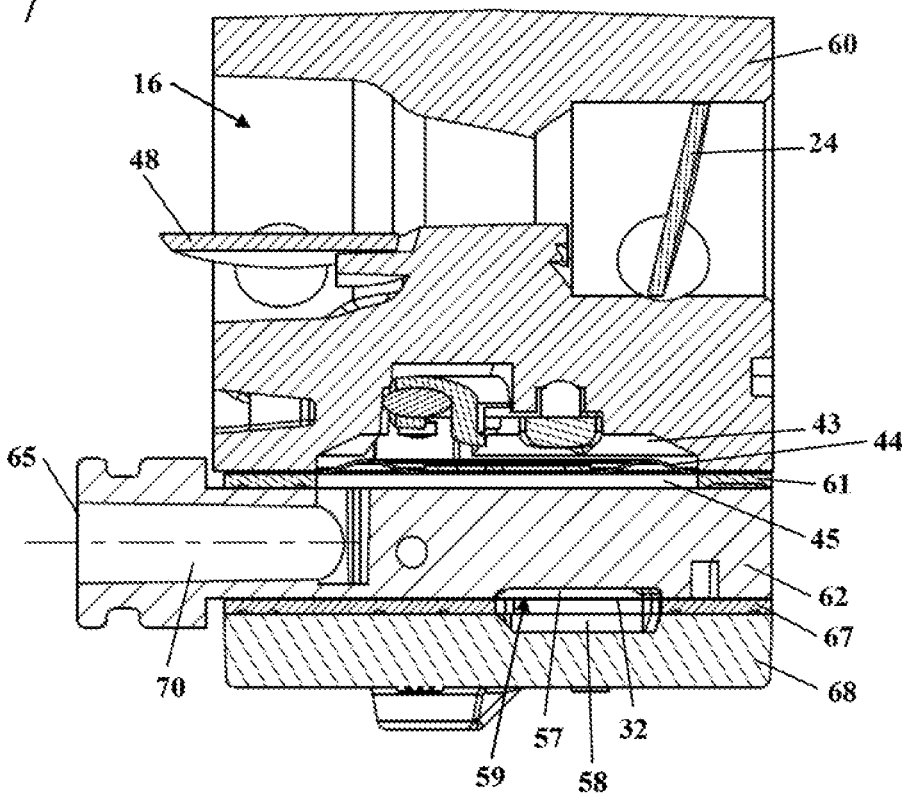
FIG. 7 shows a section along the line VII-VII in FIG. 6.

Downstream of the outlet valve 35, the fuel flows downward through a connecting line 74*a* in the pump sealing 67 and the pump cover 68 (FIG. 3). In the pump cover 68, the connecting line 74*a* is connected to a connecting line 74*b*, as schematically represented in FIG. 13 by dashed lines. The connecting line 74*b* leads back upward to the intermediate part 62, as FIG. 3 shows. The connecting line 74*b* opens by way of a connecting line 74*c* (FIG. 9) into a buffer chamber 57. The buffer chamber 57 is shown in FIG. 7. The buffer chamber 57 is separated by the pump membrane 32 from a return chamber 58. The buffer chamber 57 is connected by way of a connecting line 75*a* (FIG. 9), formed in the intermediate part 62, and a connecting line 75*b* (FIG. 3), leading upward from the intermediate part 62, to the carburetor body 60. The connecting line 75*b* opens into the control chamber 43 represented in FIGS. 7 and 8. Arranged here at the inlet into the control chamber 43 is the control valve 41 (FIG. 2). The buffer chamber 57 forms with the connecting lines 73, 74 and 75 the fuel chamber 39 (FIG. 2).

Leading from the control chamber 43 is a fuel channel 72 (FIGS. 3 and 8), which opens at the fuel outlet 64.

Figure 8:
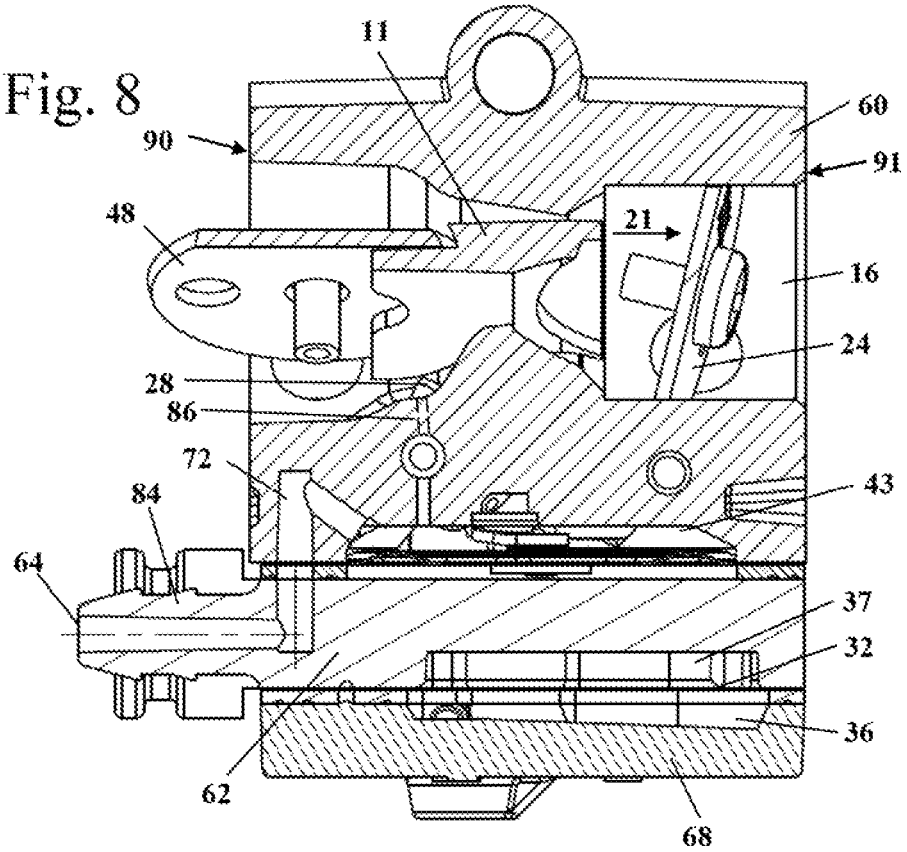
FIG. 8 shows a section along the line VIII-VIII in FIG. 6.

Also formed in the pump cover 68 is the return chamber 58 to the buffer chamber 57 (FIG. 7). As FIGS. 7 and 8 show, the buffer chamber 57 and the pump chamber 36 are arranged on opposite sides of the pump membrane 32. As shown in FIG. 7, the buffer chamber 57 is delimited by the intermediate part 62.

FIG. 3 schematically shows on the pump membrane 32 the membrane section 59 of the pump membrane 32, which delimits the buffer chamber 57, and also the membrane section 69 of the pump membrane 32, which delimits the pump chamber 36. As FIG. 3 shows, the membrane section 59 is smaller than the membrane section 69. The surface area of the membrane section 59 is advantageously at least 25%, in particular at least 30%, of the surface area of the membrane section 69.

As FIGS. 3, 7 and 8 show, the carburetor 15 is substantially made up of the carburetor body 60, the intermediate part 62, the pump cover 68 and also the seals 61 and 67 and membranes 44 and 32 lying in between.

Figure 5:
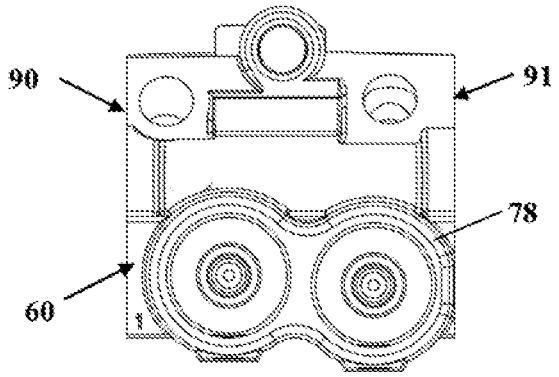
FIG. 5 shows a side view in the direction of the arrow V in FIG. 4.
Figure 6:
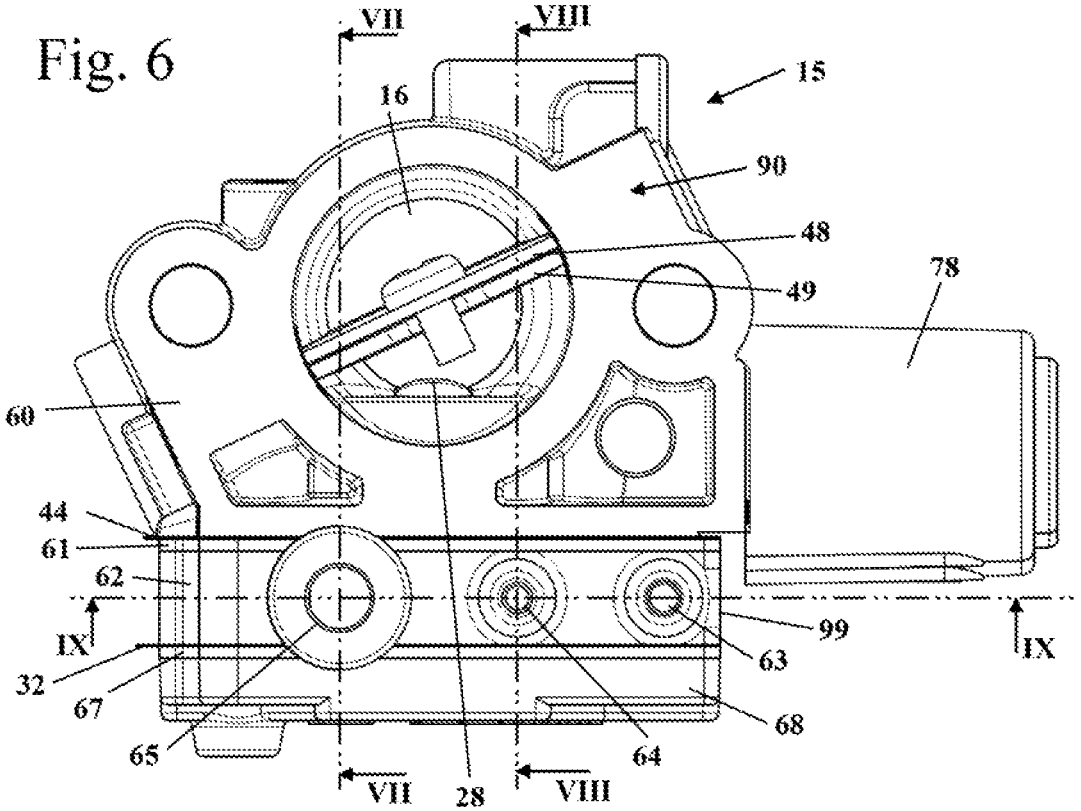
FIG. 6 shows a side view of the carburetor, seen in the direction of the downstream end of the carburetor.

As FIG. 6 shows, the choke flap 48 is pivotably mounted in the intake channel section 16 by a choke shaft 49. As FIG. 6 also shows, the carburetor 15 has an upstream end 90. The upstream end 90 is in this case arranged upstream with respect to the flow direction 21 (FIG. 1), that is, facing the air filter 22, while the downstream end 91 (FIGS. 4 and 5) lies facing the cylinder 2 of the combustion engine 1. As FIG. 6 shows, the fuel inlet 63, the fuel outlet 64 and the compensation connection 65 are aligned parallel to the upstream end 90 of the carburetor 15.

As FIG. 7 shows, the compensation connection 65 is connected by way of a compensation channel 70 to the compensation chamber 45.

As FIG. 8 schematically shows, a connecting line 86 leads out of the control chamber 43 to the fuel openings 28. At least one further connecting line (not shown) leads to the fuel openings 27 (FIG. 1). FIG. 8 also shows that the choke flap 48 is arranged upstream of the throttle flap 24 in the intake channel section 16, and that a section of the partition wall 11 runs between the choke flap 48 and the throttle flap 24.

Figure 4:
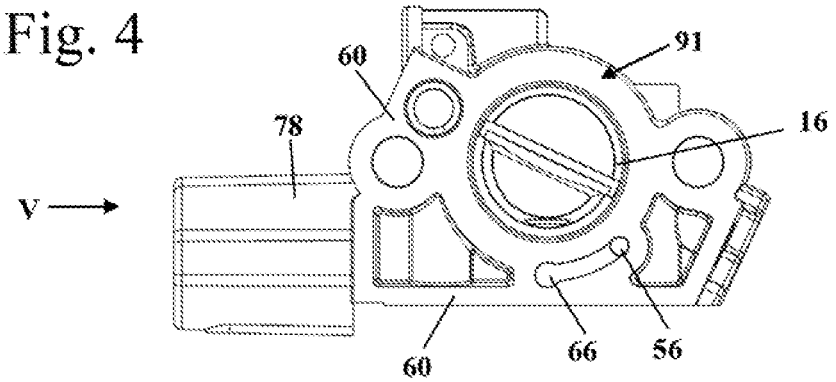
FIG. 4 shows a side view of a carburetor body of the carburetor.
Figure 10:
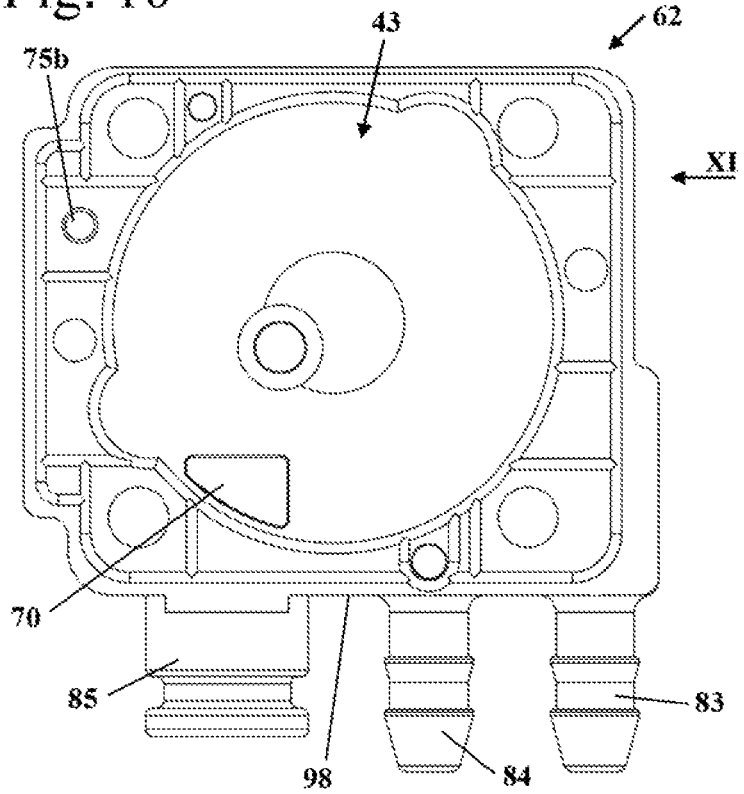
FIG. 10 shows a plan view of an intermediate part of the carburetor.

FIGS. 9 and 10 show the opening of the compensation channel 70 in the control chamber 43. As FIG. 10 shows, the control chamber 43 is formed as a depression on the side of the intermediate part 62 lying at the top in FIG. 3. As FIG. 12 shows, on the side of the intermediate part lying at the bottom in FIG. 3 there is formed a depression, which forms the pulse chamber 37. The pulse chamber 37 is connected by way of a pulse line 56, formed as a depression on the intermediate part 62, to a pulse connection 66 shown in FIG. 4. As FIG. 4 shows, the pulse connection 66 is formed at the downstream end 91 of the carburetor 15. As FIG. 3 shows, the pulse line 56 extends through the intermediate part 62, the compensation chamber seal 61 and the control membrane 44 as far as the carburetor body 60.

Figure 11:
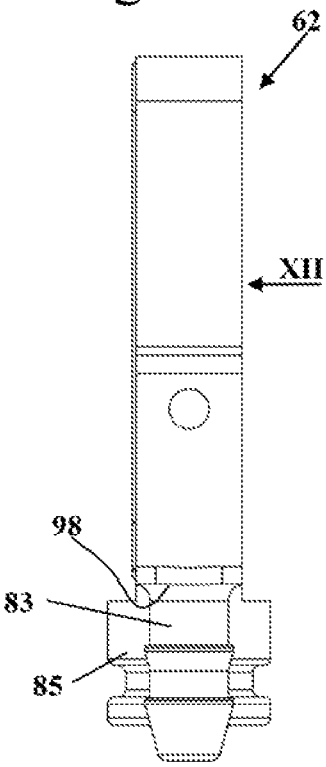
FIG. 11 shows a side view of the intermediate part in the direction of the arrow XI in FIG. 10.

FIGS. 10 and 11 also show the arrangement of the connection stubs 83, 84 and 85 on the side 98 of the intermediate part 62. In the installed state, the side 98 is arranged at the upstream end 90 of the carburetor 15 (FIG. 6).

As FIG. 12 shows, the fuel inlet 63, that is, the opening through which fuel enters the connection stub 83, is aligned in the direction of an arrow 95. The fuel outlet 64 is formed on a connection stub 84. The fuel outlet 64 is aligned in the direction of an arrow 96, which lies parallel to the arrow 95. The compensation connection 65 is formed on a connection stub 85, which is aligned in the direction of an arrow 97. The arrow 97 lies parallel to the arrows 95 and 96. As a result, connection lines can be fitted to the fuel inlet 63, the fuel outlet 64 and the compensation connection 65 in the same direction, to be specific parallel to the arrows 95, 96 and 97. The arrows 95, 96 and 97 are the normals to the respective opening and indicate the direction in which a connection is to be fitted on the respective connection stub 83, 84 and 85.

Schematically shown in FIG. 12 is a variant of the embodiment in which a connection stub 83', on which the fuel inlet 63' is formed, is arranged on a second side 99 of the intermediate part 62. In the fitted state of the carburetor 15, the second side 99 lies between the ends 90 and 91 of the carburetor 15. As FIG. 12 shows, the connection stub 83' is formed as angled away, and the fuel inlet 63' is aligned in the direction of an arrow 95', which lies parallel to the arrows 96 and 97. Also when the connection stub 83' is fixed on another side 99 of the intermediate part 62, the fuel inlet 63', the fuel outlet 64 and the compensation connection 65 can as a result be connected to connection lines in the same direction. The fuel inlet 63 or 63', the fuel outlet 64 and the compensation connection 65 face in the same direction, and are arranged on the side 98 of the carburetor 15.

In the case of another variant of the embodiment that is schematically shown in FIG. 12 by dashed lines, a fuel outlet 64' is formed on a connection stub 84'. The connection stub 84' is arranged on the second side 99 of the intermediate part 62. The connection stub 84' runs transversely, in the embodiment perpendicularly, in relation to the second side 99. "Transversely" means here that the connection stub 84' runs at an angle that is greater than 0° and less than 180° in relation to the second side 99. As a result, the fuel outlet 64' does not face in the same direction as the fuel inlet 63, 63' and the compensation connection 65 but in a direction running transversely thereto. The fuel inlet 63, 63' and the compensation connection 65 face in the same direction. The fuel outlet 64' faces in the direction of an arrow 96', which is aligned transversely, in particular perpendicularly, in relation to the arrows 95, 95' and 97. Connected to the connection stub 84' is a flexible hose 100. The flexible hose 100 is bent in the direction corresponding to the arrows 95 and 97. The connection stub 84' is also preferably molded onto the main body of the intermediate part 62.

Figure 14:
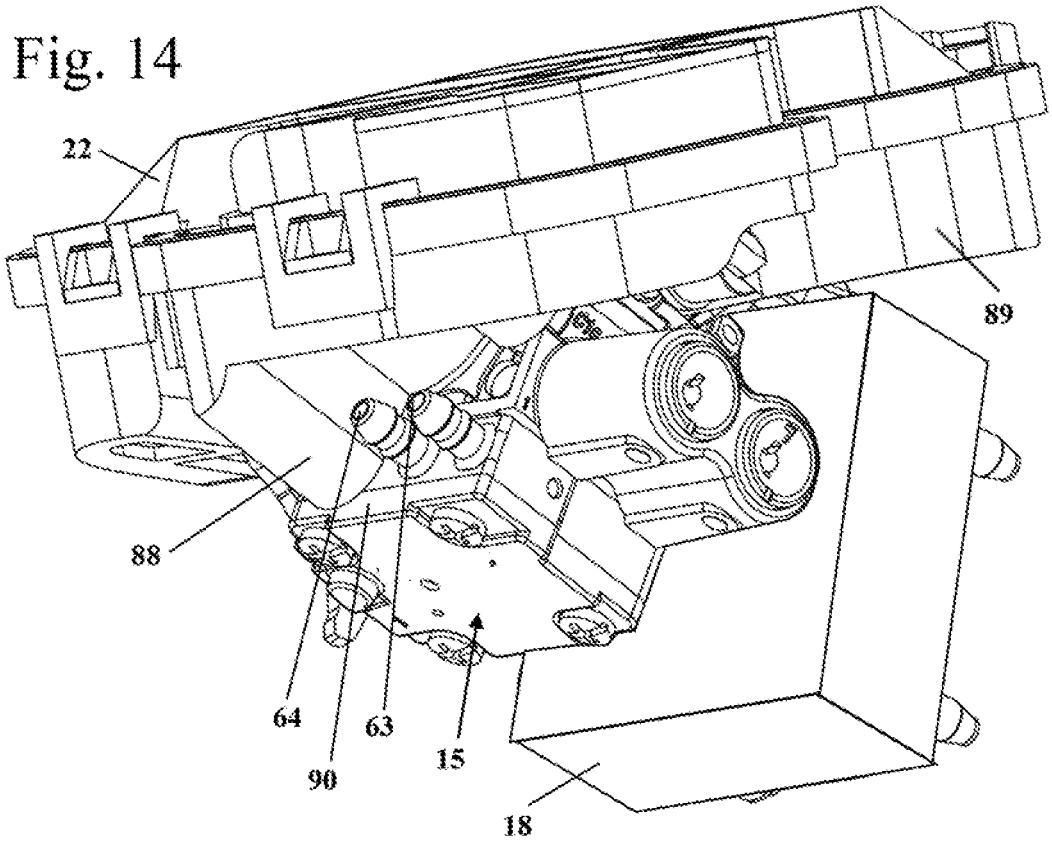
FIG. 14 shows a perspective view of the carburetor in the installation position between an air filter and a connection flange.
Figure 15:
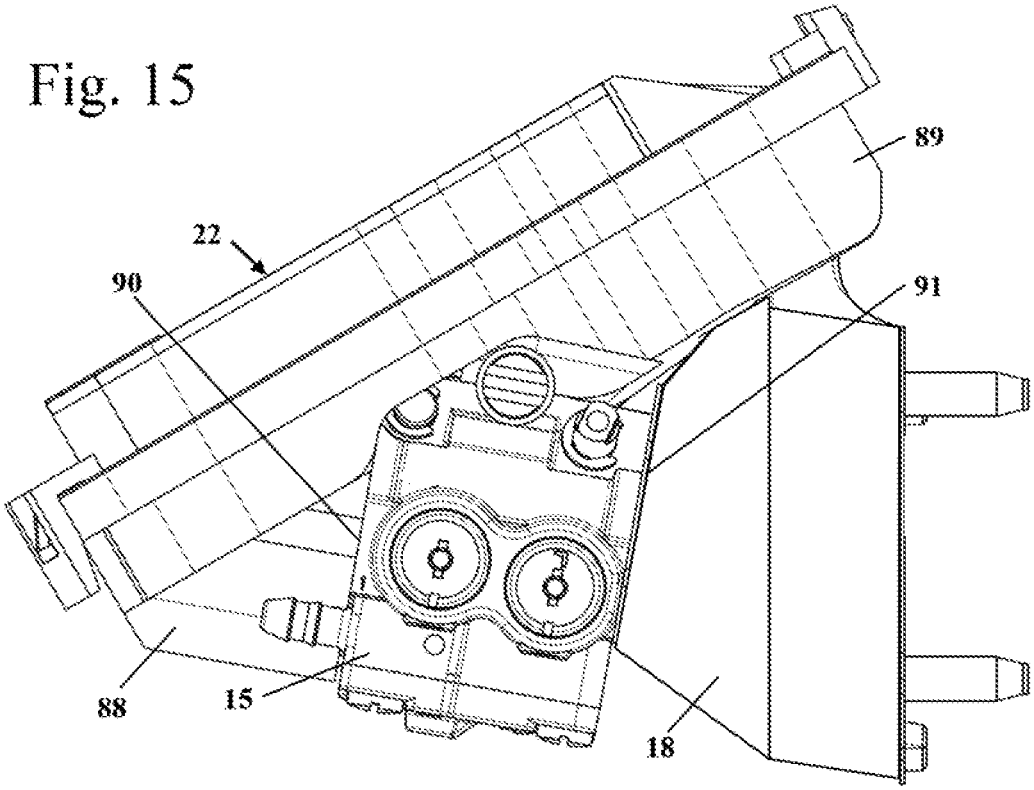
FIG. 15 shows a side view of the arrangement from FIG. 14.

As FIGS. 14 and 15 show, the air filter 22 has an air filter bottom 89, on which a connection stub 88 for connecting to the compensation connection 65 is provided. The connection stub 88 extends over the connection stub 85 of the compensation connection 65. The air filter bottom 89 and the connection stub 88 are formed in a dimensionally stable manner, for example from dimensionally stable plastic. As a result, the compensation connection 65 is directly connected when the air filter 22 is fitted on the carburetor 15. In the intermediate flange 18, the pulse line 56 is advantageously led from the pulse connection 66 on the carburetor body 60 (FIG. 4) to the combustion engine 1. The pulse connection 66 is directly connected at the same time when the carburetor 15 is fitted on the intermediate flange 18.

The upstream end 90 of the carburetor 15 is arranged facing away from the combustion engine 1. Arranged at the upstream end 90 of the carburetor 15 are the fuel inlet 63, the fuel outlet 64 and also the compensation connection 65 (FIG. 12).

Figure 16:
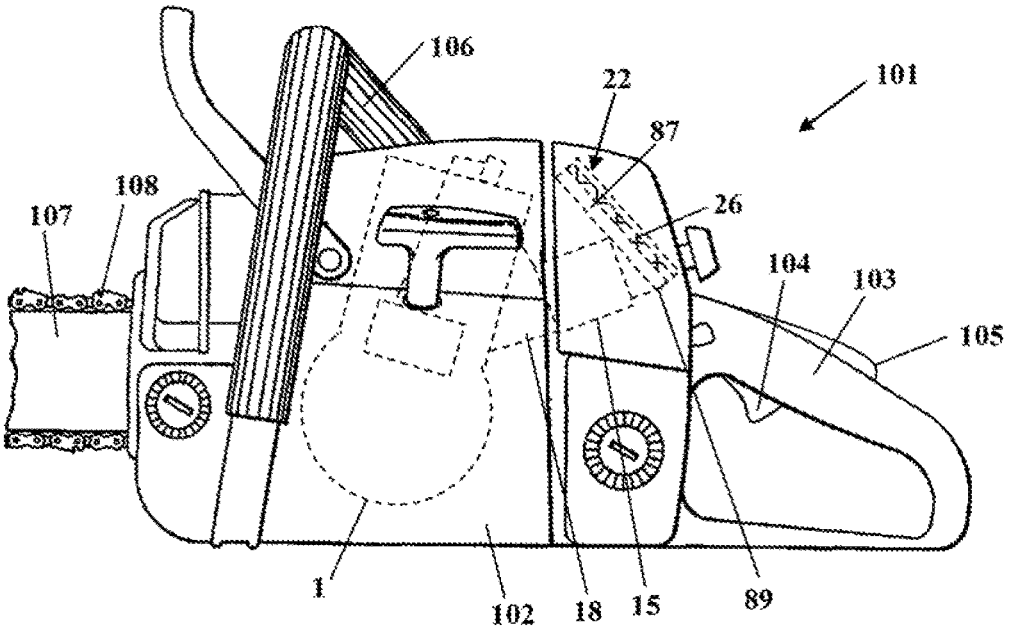
FIG. 16 shows a schematic side view of a chain saw.

FIG. 16 schematically shows the arrangement of the combustion engine 1 in a handheld work apparatus, in the embodiment a chain saw 101. The chain saw 101 has a housing 102, fixed on which are a handle 103 and also a bale handle 106 for guiding the chain saw 101 during operation. Mounted on the handle 103 are a throttle lever 104 and also a throttle lever lock 105. Fixed on the housing 102 is a guide bar 107, on which a saw chain 108 is arranged in a circulating manner. The saw chain 108 forms the tool of the chain saw 101 and is driven in a circulating manner by the combustion engine 1. The carburetor 15 is held on the combustion engine 1 by way of the intermediate flange 18. The air filter bottom 89 of the air filter 22 is fixed on the carburetor 15.

In the embodiment, a buffer chamber 57 is provided, arranged on the side of the pump membrane 32 opposite from the pump chamber 36. It may however also be advantageous to provide a number of buffer chambers 57. Preferably, the surface area of the membrane section of the pump membrane of each buffer chamber is of such a size that it is at least 25% of the surface area of the membrane section of the pump membrane that delimits the pump chamber. It may be advantageous to arrange at least one buffer chamber on the side of the pump membrane 32 on which the pump chamber 36 is also arranged.

Figure 17:
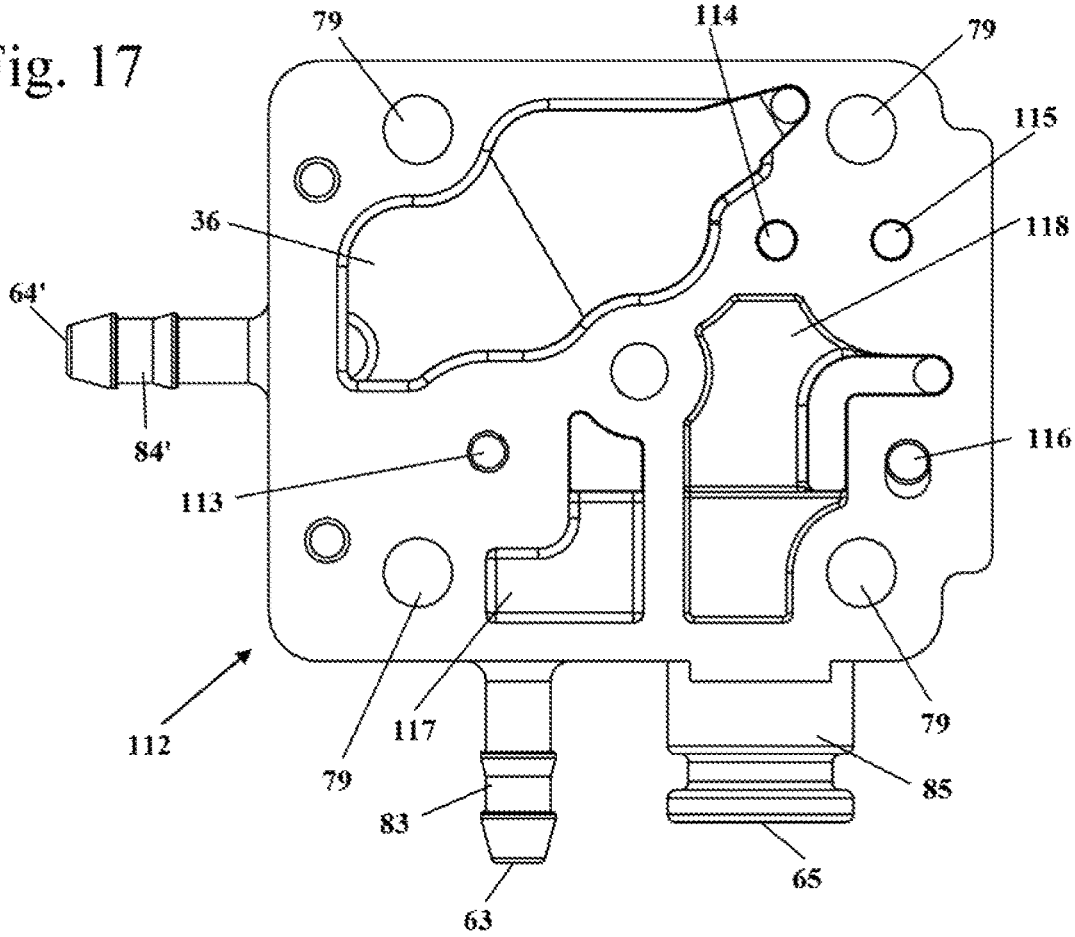
FIG. 17 shows a side view of the intermediate part of a further embodiment in a view corresponding to FIG. 12.

In FIG. 17, the intermediate part 112 of an advantageous alternative embodiment of a carburetor 15 with two buffer chambers 117 and 118 is shown. The intermediate part 112 has a fuel inlet 63, which is formed on a connection stub 83. The same designations in this case denote elements corresponding to one another in all of the embodiments. The intermediate part 112 has a compensation connection 65, which is formed on a connection stub 85. The fuel inlet 63 and the compensation connection 65 face in the same direction. At the intermediate part 112, a fuel outlet 64' is formed on a connection stub 84'. By way of the fuel inlet 63, fuel passes into a first buffer chamber 117, which is formed in the intermediate part 112 and is delimited by the pump membrane 32 not shown in FIG. 17 (see FIG. 3). From the first buffer chamber 117, the fuel passes by way of a connecting line 113 into the pump chamber 36 formed in the intermediate part 112. Also the pump chamber 36 is delimited by the pump membrane 32 (FIG. 3). The inlet valve 34 and the outlet valve 35 are not formed in the intermediate part 112, but in the pump membrane 32 (FIG. 3), and are therefore not shown in FIG. 17.

From the pump chamber 36, fuel flows by way of connecting lines 114, 115 and 116 into a second buffer chamber 118. The second buffer chamber 118 is formed in the intermediate part 112 and delimited by the pump membrane 32 (FIG. 3). From the second buffer chamber 118, the fuel passes by way of a connecting line (not shown in FIG. 17) into the control chamber 43 (FIG. 7) and by way of the connecting line 72 (FIG. 8) into the fuel outlet 64'. The further configuration of the carburetor according to the embodiment shown in FIG. 17 corresponds to the embodiment described in relation to the previous figures, the arrangement of the connecting lines being suitably adapted.

Further advantageous embodiments are obtained by any desired combination of the embodiments.

It is understood that the foregoing description is that of the preferred embodiments of the invention and that various changes and modifications may be made thereto without departing from the spirit and scope of the invention as defined in the appended claims.

What is claimed is:

1. A carburetor comprising:

a carburetor housing having an intake channel section arranged therein;

at least one fuel opening opening into said intake channel section;

a fuel pump having a pump chamber and a pump membrane delimiting said pump chamber;

a fuel inlet connected to said pump chamber;

a pressure controller defining a control chamber and a compensation chamber and having a control membrane mutually separating said control chamber and said compensation chamber;

said control chamber supplying said at least one fuel opening;

a fuel outlet leading out of said carburetor;

said control chamber being connected to said fuel outlet;

a compensation connection;

said compensation chamber being connected to said compensation connection;

said carburetor housing including: a carburetor body wherein said intake channel section is formed; a pump cover at least partially delimiting said pump chamber; and, an intermediate part disposed between said pump cover and said carburetor body; and, said fuel inlet, said fuel outlet and said compensation connection being configured on said intermediate part.

2. The carburetor of claim 1, wherein said fuel inlet and said compensation connection are directed in the same direction.

3. The carburetor of claim 1, wherein said fuel inlet and said compensation connection are formed on respective connection stubs arranged on a same side of said carburetor housing.

4. The carburetor of claim 3, wherein said carburetor housing has a first end lying upstream referred to a flow direction in said intake channel section and a second end lying downstream; and, the connection stubs corresponding to said fuel inlet and said compensation connection are arranged on said upstream end of said carburetor housing.

5. The carburetor of claim 1, wherein said fuel inlet and the compensation connection are formed on respective connection stubs that are integrally formed on said intermediate part as one part.

6. The carburetor of claim 1, wherein the compensation connection is formed on a connection stub for connecting to a clean space of an air filter.

7. The carburetor of claim 1, wherein said pressure controller is delimited by said carburetor body and said intermediate part.

8. The carburetor of claim 1, wherein said fuel pump is delimited by said intermediate part and said pump cover.

9. The carburetor of claim 1, wherein said fuel inlet and said fuel outlet are connected to each other via a flow path; and, said carburetor further comprises at least one buffer chamber which is arranged in said flow path and which is at least partially delimited by said pump membrane.

10. The carburetor of claim 9, wherein said pump chamber and said at least one buffer chamber are arranged on opposite sides of said pump membrane.

11. The carburetor of claim 9, wherein said carburetor further comprises a return chamber; said pump membrane separates said at least one buffer chamber from said return chamber; and, said return chamber is delimited by said pump cover.

12. The carburetor of claim 9, wherein said at least one buffer chamber is at least partially delimited by said intermediate part.

13. The carburetor of claim 9, wherein the surface area of the membrane section of the pump membrane that delimits said at least one buffer chamber is at least 25% of the surface area of the membrane section of the pump membrane that delimits the pump chamber.

14. The carburetor of claim 1, wherein said carburetor further comprises a pulse chamber; said pump membrane separates said pump chamber from said pulse chamber; and, said pulse chamber is connected by a pulse line to a pulse connection and said pulse line is at least partially delimited by said intermediate part.

15. A handheld work apparatus comprising:

a combustion engine for driving a tool of the work apparatus;

said combustion engine having a carburetor with a carburetor housing having an intake channel section arranged therein;

at least one fuel opening opening into said intake channel section;

a fuel pump having a pump chamber and a pump membrane delimiting said pump chamber;

a fuel inlet connected to said pump chamber;

a pressure controller defining a control chamber and a compensation chamber and having a control membrane mutually separating said control chamber and said compensation chamber;

said control chamber supplying said at least one fuel opening;

a fuel outlet leading out of said carburetor;

said control chamber being connected to said fuel outlet;

a compensation connection;

said compensation chamber being connected to said compensation connection;

said carburetor housing including: a carburetor body wherein said intake channel section is formed; a pump cover at least partially delimiting said pump chamber; and, an intermediate part disposed between said pump cover and said carburetor body;

said fuel inlet, said fuel outlet and said compensation connection being configured on said intermediate part; and, said fuel inlet and said compensation connection being arranged on a side of said carburetor that faces away from said combustion engine.

16. A carburetor comprising:

a carburetor housing having an intake channel section arranged therein;

at least one fuel opening opening into said intake channel section;

a fuel pump having a pump chamber and a pump membrane delimiting said pump chamber;

a fuel inlet connected to said pump chamber;

a pressure controller defining a control chamber and a compensation chamber and having a control membrane mutually separating said control chamber and said compensation chamber;

said control chamber supplying said at least one fuel opening;

a fuel outlet leading out of said carburetor;

said control chamber being connected to said fuel outlet;

a compensation connection;

said compensation chamber being connected to said compensation connection;

said carburetor housing including: a carburetor body wherein said intake channel section is formed; a pump cover at least partially delimiting said pump chamber; and, an intermediate part disposed between said pump cover and said carburetor body; and, said fuel inlet, said fuel outlet and said compensation connection being configured on said intermediate part, wherein said fuel inlet and said compensation connection are directed in the same direction.

* * * * *